US008671723B2

(12) United States Patent
Dayanikli et al.

(10) Patent No.: US 8,671,723 B2
(45) Date of Patent: Mar. 18, 2014

(54) MICRO MOTOR LOCKING SYSTEM

(75) Inventors: Vehbi Dayanikli, Bursa (TR); Mustafa Dayanikli, Bursa (TR)

(73) Assignee: Vemus Endüstriyel Elektronik Sanayi ve Ticaret Limited Şirketi (TK)

( * ) Notice: Subject to any disclaimer, the term of this patent is extended or adjusted under 35 U.S.C. 154(b) by 33 days.

(21) Appl. No.: 12/744,845

(22) PCT Filed: Feb. 5, 2009

(86) PCT No.: PCT/TR2009/000017

§ 371 (c)(1),
(2), (4) Date: May 26, 2010

(87) PCT Pub. No.: WO2009/120159

PCT Pub. Date: Oct. 1, 2009

(65) Prior Publication Data

US 2010/0251787 A1 Oct. 7, 2010

(30) Foreign Application Priority Data

Mar. 24, 2008 (TR) ..... 2008 01927

(51) Int. Cl.
*E05B 47/06* (2006.01)

(52) U.S. Cl.
USPC ..... 70/278.7; 70/280; 70/283

(58) Field of Classification Search
USPC ..... 70/277, 278.7, 279.1, 280–283; 292/144
See application file for complete search history.

(56) References Cited

U.S. PATENT DOCUMENTS

| | | | | | |
|---|---|---|---|---|---|
| 3,854,310 | A | * | 12/1974 | Paull et al. | 70/280 |
| 5,474,348 | A | * | 12/1995 | Palmer et al. | 292/359 |
| 5,715,715 | A | * | 2/1998 | Nunez | 70/283 |
| 5,791,179 | A | * | 8/1998 | Brask | 70/278.1 |
| 6,112,563 | A | * | 9/2000 | Ramos | 70/278.1 |
| 6,145,353 | A | | 11/2000 | Doucet | |
| 6,213,524 | B1 | * | 4/2001 | Bree et al. | 292/201 |
| 6,282,931 | B1 | * | 9/2001 | Padiak et al. | 70/279.1 |
| 6,363,762 | B1 | * | 4/2002 | Kueng | 70/278.3 |
| 6,370,928 | B1 | * | 4/2002 | Chies et al. | 70/278.3 |
| 6,381,999 | B1 | * | 5/2002 | Doong | 70/107 |
| 6,526,790 | B2 | * | 3/2003 | Wegner | 70/277 |

(Continued)

FOREIGN PATENT DOCUMENTS

| | | | |
|---|---|---|---|
| DE | 19812276 | C1 | 5/1999 |
| GB | 2048362 | A | 12/1980 |
| KR | 20030019541 | A | 3/2003 |
| WO | 2006115335 | A1 | 11/2006 |

*Primary Examiner* — Lloyd Gall
(74) *Attorney, Agent, or Firm* — Akerman LLP

(57) ABSTRACT

A micro motor locking bolt system (8) comprising a locking bolt (5) mounted inside a lock (11) in order to provide a locking function in electronic gates, drawers, cabinets, safes and similar structures. The locking bolt system has a locking position by entering into a lock housing (13) structured on the lock (11) and an unlocking position by removing from the lock housing (13). A motor (1) provides the necessary driving force in order for the locking bolt (5) to enter into and be removed from the lock housing (13). A worm gear (2) performs rotational motion around its own axis due to the driving force from the motor (1) and comprises grooved parts (2.1) thereon. Motion transmission members transfer the rotational motion of the worm gear (2) to the locking bolt (5) by transforming the rotational motion into linear motion.

8 Claims, 5 Drawing Sheets

(56) References Cited

U.S. PATENT DOCUMENTS

| | | | | |
|---|---|---|---|---|
| 6,851,291 | B2 * | 2/2005 | Nunez | 70/283 |
| 7,168,276 | B2 * | 1/2007 | Errani et al. | 70/278.7 |
| 7,188,495 | B2 * | 3/2007 | Errani et al. | 70/278.7 |
| 7,966,854 | B2 * | 6/2011 | Imedio Ocana | 70/472 |
| 2001/0005998 | A1 * | 7/2001 | Imedio Ocana | 70/277 |
| 2001/0018837 | A1 | 9/2001 | Imedio Ocana | |
| 2002/0062670 | A1 * | 5/2002 | Doong | 70/279.1 |
| 2004/0089040 | A1 * | 5/2004 | Raatikainen | 70/283 |
| 2005/0092046 | A1 * | 5/2005 | Errani et al. | 70/283 |
| 2007/0052251 | A1 | 3/2007 | Hautala et al. | |
| 2008/0303290 | A1 * | 12/2008 | Yuan | 292/195 |
| 2009/0178449 | A1 * | 7/2009 | Raatikainen | 70/263 |
| 2009/0277231 | A1 * | 11/2009 | Kim | 70/275 |
| 2010/0000273 | A1 * | 1/2010 | Viso Cabrera et al. | 70/277 |
| 2010/0000274 | A1 * | 1/2010 | Viso Cabrera et al. | 70/278.7 |

* cited by examiner

MICRO MOTOR LOCKING SYSTEM

THE RELATED ART

The invention relates to micro motor locking systems comprising a locking bolt mounted inside a lock in order to provide locking of electronic gates, drawers, cabinet, safe and similar structures, the locking bolt having a locking position by entering into a lock housing structured on the lock and an unlocking position by removing from the lock housing; a motor providing a driving force for the locking bolt to enter into the lock housing and remove from the lock housing; a worm gear performing rotational motion around its own axis by means of the driving force from the motor; and members transferring the rotational motion of the worm gear to the locking bolt by transforming the rotational motion into at linear motion of the locking bolt.

BACKGROUND OF THE RELATED ART

Today it is known that embodiments such as electronic gates, drawers, cabinets, safe and similar structures are used for controlled passing systems. In such types of locking systems, the user enters his/her password by use of a key set and the aim is to provide a secure and safe passing.

In the existing electronic locks, electromagnet bobbin (solenoid bobbin) is used. Such bobbins consume too much power during locking or unlocking. And this causes burning of driving centre.

In the known related art, too much power is consumed for the voltage and ampere values in locking systems and this causes short operating life of electronic locking systems.

In the existing status of the related art, electro-magnets are used in other electronic locking systems. In such systems, the position can be changed by means of spontaneous power. However, in such systems lock bolts can leave the housing easily, that is, the locking distance is considerably short. This can cause removal of the lock from the housing with a small stroke.

In the related art, the sizes of electronic locking systems are too big and number of parts is too many, which causes increase in cost of production and problem in aesthetics.

In the related art, electronic locking systems are not secure due to the reasons given above, which cause risk on life of people and problems in safety.

In the related art, several embodiments related to electronic locking systems are known. One of those embodiments is disclosed under Korean patent application numbered KR20030019541 where an electronic locking system in which security is ensured by means of a secret password entrance or remote control is disclosed. The battery on the body of the locking system is used as power source. Locking member is within locking part and locking is provided in this way.

Another application is the German Patent application numbered DE19812276 which relates to locking mechanism developed for use in buildings. The locking mechanism which is unlocked by use of key can also be unlocked by use of a circuit switch. The electric power in such locking system is converted into motion power by means of electrical magnet or motor.

In conclusion, developments in parallel to development in electronic locks are made and for that reason, it has been needed to make new embodiments which will eliminate the disadvantages mentioned above and bring solution to current systems.

PURPOSE OF THE INVENTION

The present invention relates to a locking system of micro driving centered lock meeting the above mentioned requirements, eliminating all disadvantages and bringing some additional advantages.

The purpose of the invention is to provide electronic locking system having micro driving lock requiring less power.

Another purpose of the invention is to provide smaller sizes and decrease number of parts to reduce cost and thus provide a locking system of good aesthetic appearance.

A further purpose of the invention is to provide an electronic locking system consisting of micro driving lock resistant against strokes ensuring secure locking.

Another purpose of the invention is to provide a long life locking system by means of preventing burning of driving center.

A further purpose of the invention is to provide a locking system ensuring comfort in addition to security feeling for the user.

A further purpose of the invention is to provide cost decrease by means of electronic locking system.

Another purpose of the invention is to provide an electronic locking system operating at lower voltages.

One of the most important purposes of the invention is to provide a secure looking distance.

In order to realize all the advantages mentioned above and to be better understood from the detailed description provided below, the invention is to develop a micro motor locking system, comprising a locking bolt mounted inside a lock in order to provide locking of electronic gates, drawers, cabinet, safe and similar ones, the locking bolt having a locking position by entering into a lock housing structured on the lock and an unlocking position by removing from the lock housing; a motor providing a driving force for the locking bolt to enter into the lock housing and remove from the lock housing; a worm gear performing rotational motion around its own axis by means of the driving force from the motor; and members transferring the rotational motion of the worm gear to the locking bolt by transforming the rotational motion into a linear motion of the locking bolt, needing lower power requirement, ensuring lower cost due to less number of parts and small sites, capable to operate at lower voltages and providing secure locking distance.

The structural and characteristic features of the invention as well as all advantages will be better understood in the detailed description provided by use and reference to the figures given below, and for that reason the assessment should be made based on the said figures and detailed description.

BRIEF DESCRIPTION OF THE FIGURES

In order that the embodiment and additional members as well as all advantages be better understood, the assessment should be made based on the said figures described below.

REFERENCE NUMBERS

Figure 1:
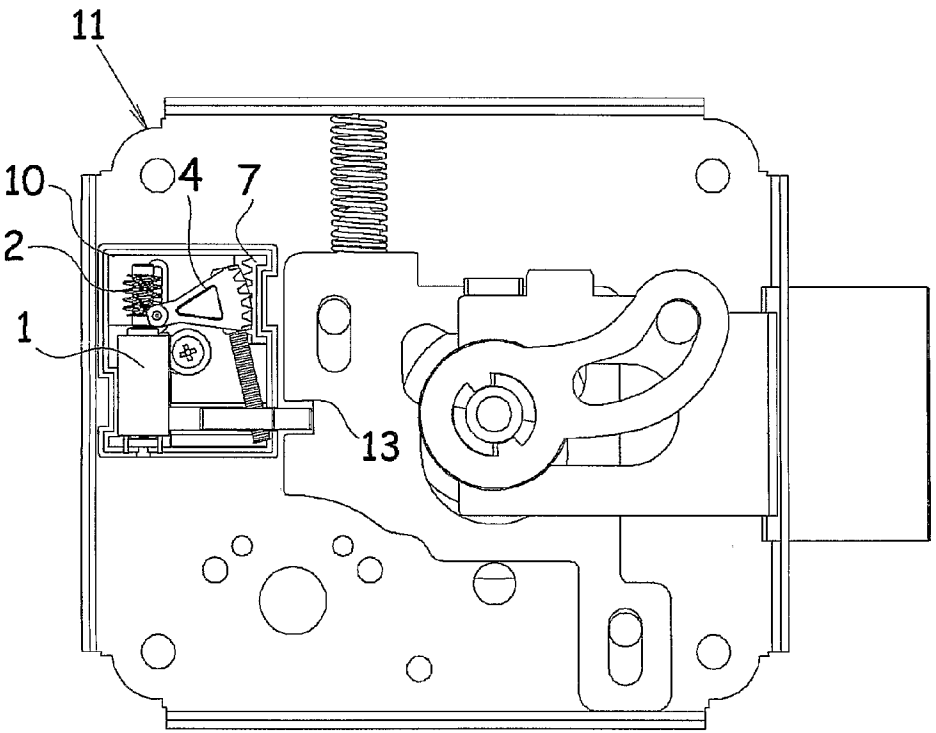
FIG. 1 Upper two dimensioned view of the representative sample of the lock used in the micro motor locking system being subject of the invention.
Figure 3:
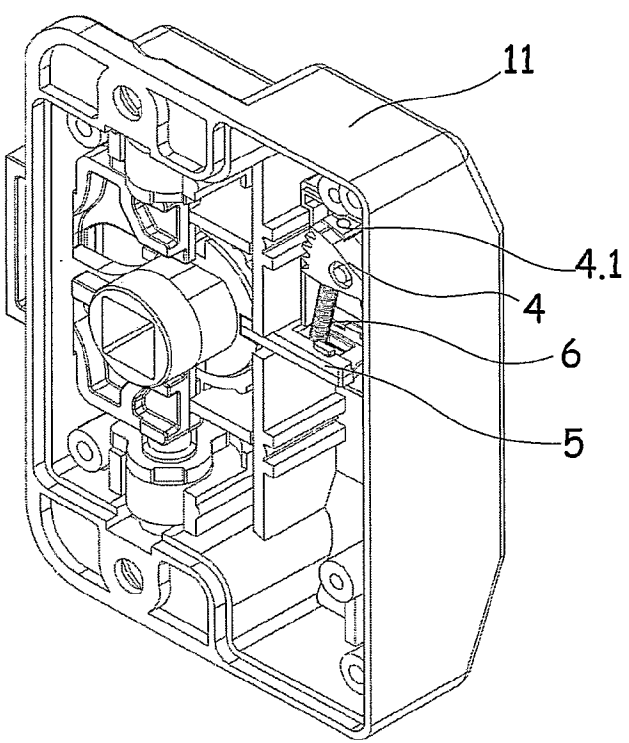
FIG. 3 Side perspective view of another representative sample of lock used in the micro motor locking system being subject of the invention.
Figure 2:
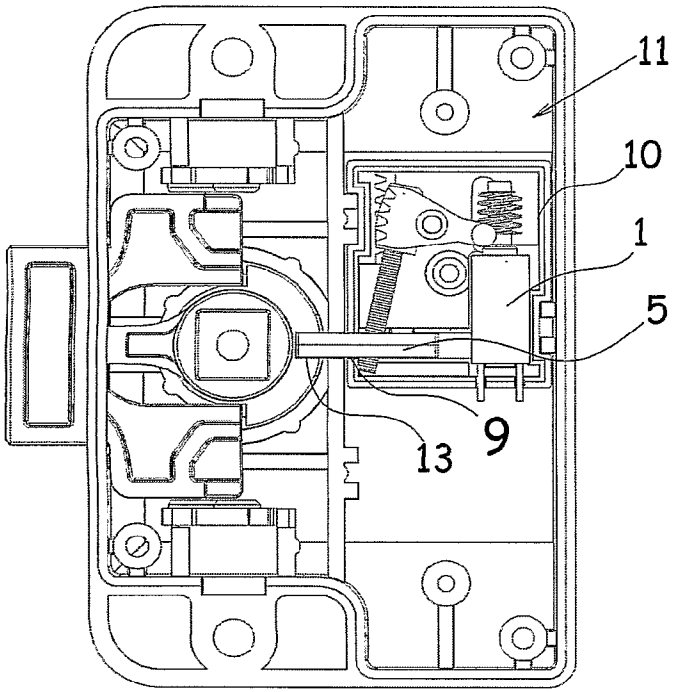
FIG. 2 Upper two dimensioned view of the representative sample of another lock used in the micro motor locking system being subject of the invention.
Figure 4:
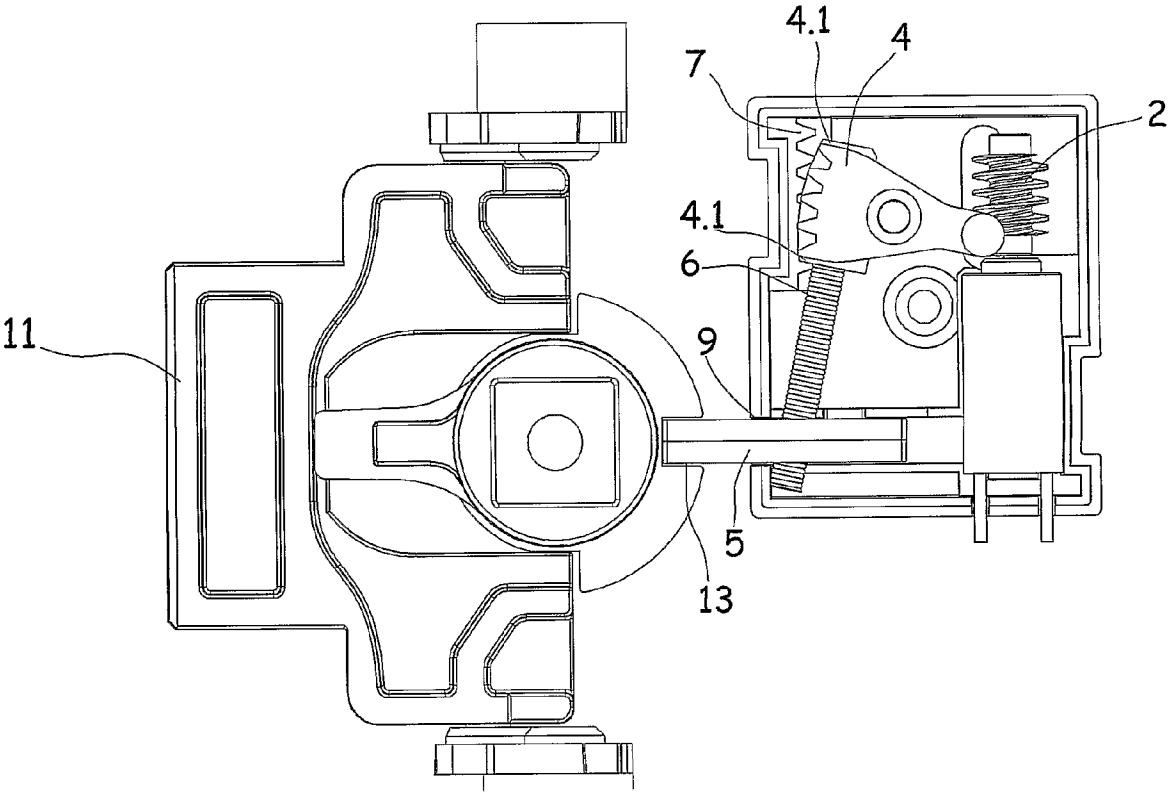
FIG. 4 Upper two dimensioned view of another representative sample of lock used in the micro motor locking system being subject of the invention.

1. Motor
2. Worm gear
2.1 Grooved Part
3 Shaft
3.1 Connection member
3.2 Housing
4. First Motion transmission member
4.1. Compression members
4.2. First motion transmission member side surfaces
4.3. Teeth
5. Locking Bolt
5.1. Motion transmission member housing
5.2. Housing Wall
6. Second Motion transmission member
7. Guiding member
7.1. Guidance member teeth
8. Micro motor locking system
9. Body Housing
10. Support body
11. Lock
12. Power source
13. Lock housing
A: Locking Direction
B: Unlocking Direction
C: Lock Bolt Up Motion Direction
D: Lock Bolt Down Motion Direction
+R: Worm Gear Rotation Direction
−R: Worm Gear Rotation Direction
d: Distance Between Two Grooves
α: Motion Angle

DETAILED DESCRIPTION OF THE INVENTION

In this detailed description of the invention, the preferred embodiments of the micro motor locking system (8) being subject of this invention have been described only for the purpose of better understanding of the subject without any restrictive effects.

The lock (11) samples in which a micro motor locking bolt system (8) according to the invention is used are shown in FIGS. 1, 2, 3 and 4. Based on this, the purpose of the invention is to enable locking process in such a manner that the locking bolt (5) connected to the micro motor locking bolt system (8) enters into the lock housing (13) structured on the lock (11). The micro motor locking bolt system (8) is mounted into a support body (10). A body housing (9) is structured at the same direction with the said lock housing (13) on the support body (10). Thanks to this body housing (9), the locking bolt (5) enters into and removes from the lock housing (13). In order to check if the locking process is performed or not, sensors (not shown in the figure) are used.

The micro motor locking system (8) includes a guiding member (7) comprising teeth (7.1) structured in saw tooth form and arranged linearly to form a rack gear, and a first motion transmission member (4) having a generally tapered shape with a shaft (3) connected at a narrow end thereof and comprising teeth (4.3) structured in a saw tooth form at a wide end thereof, the teeth extending through a segment of a circle to mesh with the teeth (7.1) provided on the said guiding member (7). There is a second motion transmission member (6) connected at one end thereof to the first motion transmission member (4) via compression member (4.1). The second motion transmission member (6) is preferably a spring. Alternatively, rubber made of rigid plastic and/or plastic derivatives having the same function can be used instead of a spring. The other free end of the second motion transmission member (6) is positioned inside the housing (5.1) structured on the locking bolt (5). On the first motion transmission member (4), there is a housing (3.2) structured in semilunar form and the shaft (3) mounted to the said housing (3.2) via connection members (3.1).

Moreover, the micro motor locking system (8) includes a motor (1) in order to provide the driving force required by the system for the locking bolt (5) to enter into the lock housing (13) and a worm gear (2) connected to the motor (1) and performing a rotational motion around its own axis thanks to the driving force from the motor (1) and having a helical groove/worm tooth (2.1) thereon.

Figure 9:
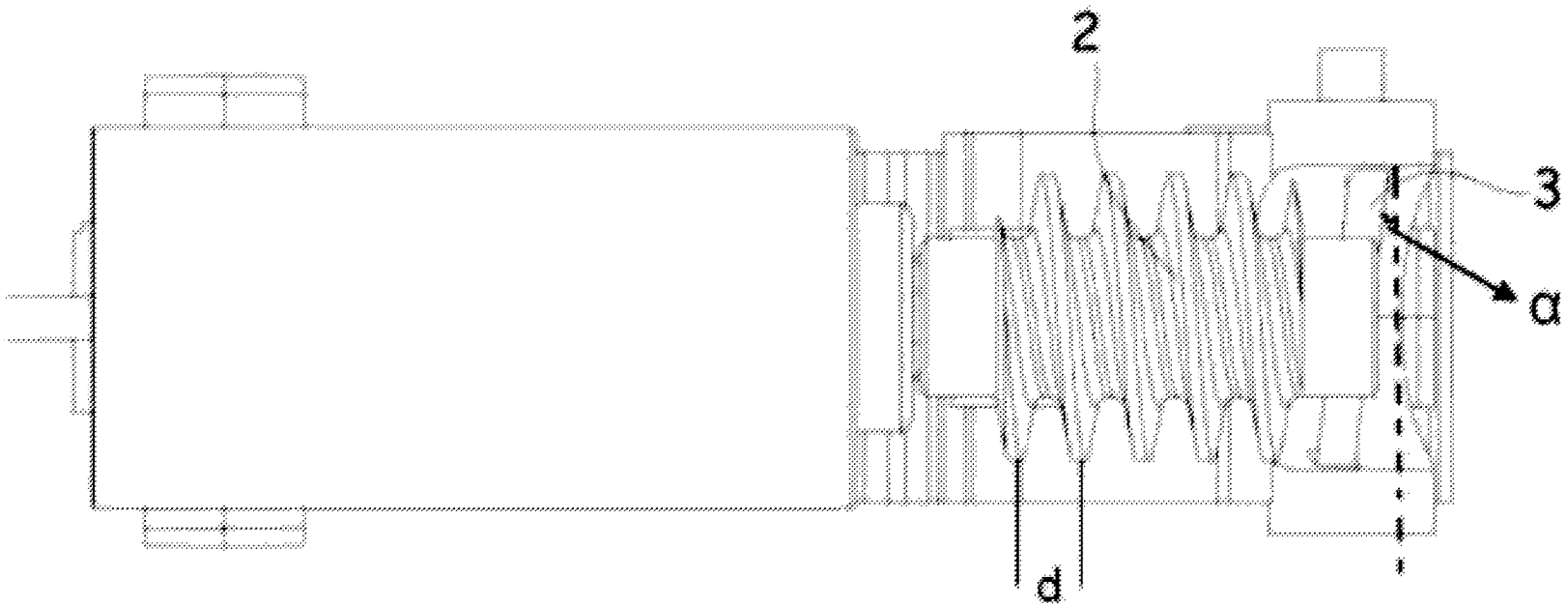
FIG. 9 Upper representative view of the locking system being subject of the invention.

The worm gear (2) can rotate in the direction of +R, and −R which is in the reverse direction of +R, by means of the driving force from the motor (1). When the worm gear (2) starts its rotational motion with the driving force from the motor (1), the shaft (3) moves through the end of the worm tooth (2.1) thanks to the helically grooved form of the worm gear (2) and becomes free of the worm gear. Thus, the free motion of the worm gear (2) is provided, the rotational motion of the motor (1) is not limited and sticking of the mechanism is prevented, as continued rotation of the worm gear (2) in the same direction does not cause further movement of the shaft (3). As it is seen in FIG. 9, the shaft (3) is connected to the housing (3.2) in such a manner to have a motion angle (α). The motion angle (α) is adjusted so as to be in combination with the distance (d) of the worm gear (2) between two grooves of the worm tooth. In other words, when the worm gear (2) rotates one tour, shaft (3) moves as much as "d" distance. Thus, the shaft (3) can move on the worm gear (2) in an easy manner.

During this motion, which shaft (3) performs through the grooved part (2.1) of the worm gear (2), it moves the first motion transmission member (4) to which it is attached at the narrow end thereof. The first motion transmission member (4) rocks and moves on guiding member (7) via teeth (4.3). The teeth (4.3) move on the guiding member teeth (7.1) by means of the driving force from the first motion transmission member (4) thanks to the structure of the teeth (4.3) being arranged through a segment of a circle at the wide end of the first motion transmission member (4). In a more detailed description, the motion of first motion transmission member (4) on guiding member (7) is as follows. When the shaft (3) starts its motion, it pulls the narrow end of the first motion transmission member (4) and moves it in the same direction as itself. As the teeth (4.3, 7.1) on the first motion transmission member (4) and guiding member (7) are structured so as to mesh with each other, in other words, in such a form that a tooth (4.3) belonging to the first motion transmission member (4) will be placed between two teeth (7.1) structured on the guiding member (7), and they are arranged to form segment of a circle, the teeth (4.3) are enabled to move through by placing onto the teeth (7.1) on the guiding member (7).

In accordance with the motion of the first motion transmission member (4) on the guiding member (7), second motion transmission member (6) connected to the first motion transmission member (4) moves up (D) and down (C) on the housing (5.1) on the locking bolt (5). During this up and down (C,D) motion, the second motion transmission member (6) applies pressure to the housing walls (5.2) and causes the locking bolt (5) to move up (D) or down (C) in the same direction. Thus, rotational motion of the worm gear (2) is transformed into a linear motion performed in a vertical direction thanks to the shaft (3), the guiding member (7) and the first motion transmission member (4) moving on the guiding member (7) and transferred to the locking bolt (5). The guiding member (7) is preferably a rack gear. When the locking bolt (5) moves down (C), it is placed into the lock housing (13) and thus, the locking process is performed, and when the locking bolt (5) moves up (D), it is removed from the lock housing (13) and becomes free, thus the lock is unlocked.

The second motion transmission member (6) enables the locking bolt (5) move up and down at the direction of lock housing (13) and provides locking and unlocking processes, and also:

When the shaft (3) passes the helically grooved worm tooth and becomes free, the second motion transmission member (6) performs its motion up (C) and down (D) inside the lock housing (13) at maximum level in accordance with the rotation direction of the motor (1). In other words, it is at the most tensioned position in each case. Thus, thanks to the re-activation of the motor (1), the shaft (3) can be kept under pressure at the reverse direction of this direction in order to be made ready to perform a motion in the reverse direction of the first motion.

In case that the linear motion is prevented, in other words, the locking bolt (5) is struck, compelled or forced; the motor (1) is enabled to complete its tour by rotating thanks to the flexible form of the second motion transmission member (6). Thus, when the striking or compulsion is over, the locking and unlocking processes are performed.

The locking bolt (5) provides the lock (11), to which it is connected, to be in locked position by entering into the lock housing (13) by means of the driving force of the motor; and provides the lock to be in unlocked position by removing from the lock housing (13). The unlocked position of the lock (11) is given in FIGS. 5 and 7; the locked position of the lock (11) is given in FIGS. 6 and 8.

Figure 6:
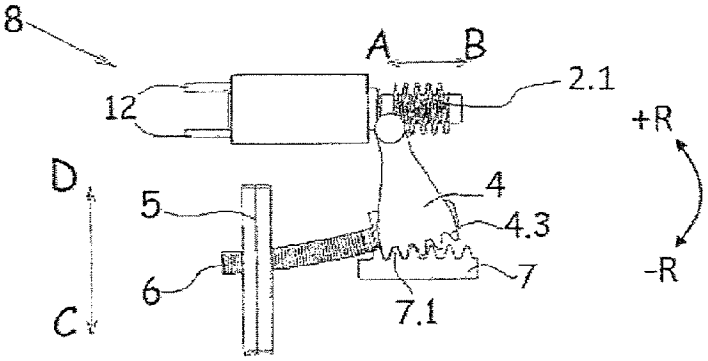
FIG. 6 Upper two dimensioned view of representative sample of lock system of the invention in close position.
Figure 8:
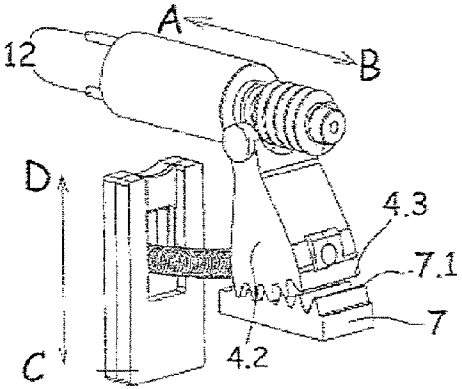
FIG. 8 Front perspective view of representative sample of lock system of the invention in close position.
Figure 5:
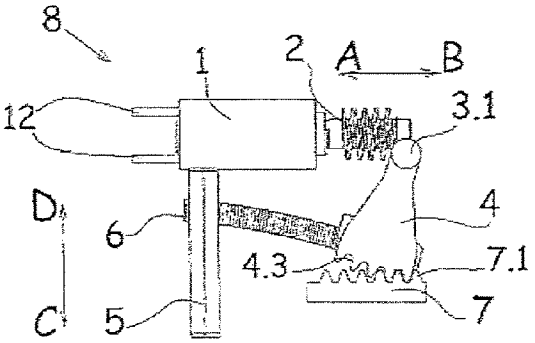
FIG. 5 Upper two dimensioned view of representative sample of lock system of the invention in open position.
Figure 7:
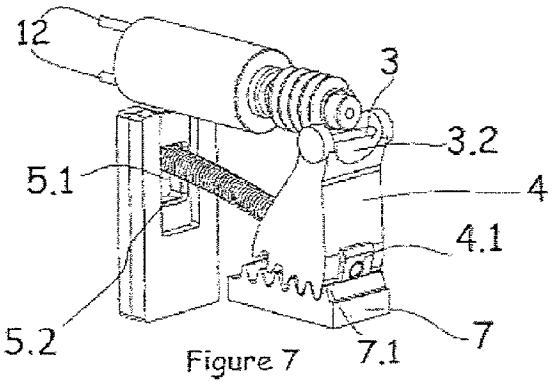
FIG. 7 Front perspective view of representative sample of lock system of the invention in open position.

In the light of the explanations given above, the transmission of the lock from the unlocked position in FIGS. 5 and 7 to the locked position in FIGS. 6 and 8 within the locking bolt system (8) is performed as follows. When the motor (1) is activated, the worm gear (2) rotates at +R direction by means of the driving force from the motor (1). During this motion, the shaft (3) moves by passing the grooved worm tooth (2.1) respectively in the (A) direction orthogonal to the locking direction (C) that will cause the locking bolt (5) on the worm gear (2) to be placed into the lock housing (13). During the motion of the shaft (3) in the locking direction (A), it causes the first motion transmission member (4) to move in the same direction (A direction) by following the guiding member teeth (7.1). In accordance with this motion of the first motion transmission member (4), the second motion transmission member (6) moves down (C) inside the housing (5.1) and it also makes the locking bolt (5) move at the same direction (C) by applying pressure on the housing walls. Thus, the rotational movement of the worm gear (2) is transformed into linear motion which is performed in a vertical direction by locking bolt (5). Thanks to the down (C) motion of the locking bolt (5) inside the lock housing (13), it enters into the lock housing (13) and the locking process is performed.

The transmission of the lock from the locked position in FIGS. 6 and 8 to the unlocked position in FIGS. 5 and 7 within the locking bolt system (8) is performed as follows. The motor (1) is re-activated, but at this time, the worm gear (2) is caused to rotate in the −R direction by means of the driving force from the motor (1). During this motion, of the worm gear (2), shaft (3) moves by passing the grooved worm tooth (2.1) respectively in the (B) direction that will cause the locking bolt (5) on the worm gear (2) to be removed from the lock housing (13) in the unlocking direction (D). During the motion of the shaft (3) in the unlocking direction (B), it causes the first motion transmission member (4) to move in the same direction (B direction) by following the guiding member teeth (7.1). In accordance with this motion of the first motion transmission member (4), the second motion transmission member (6) moves up (D) and it also makes the locking bolt (5) move at the same direction (D direction) by applying pressure on the housing walls (5.2). Thus, the rotational movement of the worm gear (2) is transformed into linear motion which is performed in a vertical direction by locking bolt (5). Thanks to the up (D) motion of the locking bolt (5) inside the lock housing (13), it is removed from the lock housing (13) and the unlocking process is performed.

During the performance of the up-down motion of the locking bolt (5), the shaft (3) pushes and pulls the first motion transmission member (4) on the guiding member (7) at the same direction with itself. During this motion, the power increase is caused according to the gear-wheel division ratio obtained between the first motion transmission member (4) and the guiding member (7). Thus, it is caused in the short time that the motor (1) and locking bolt (5) enter into lock housing (13) or remove the lock housing (13), in other words, a shorter operation time for the motor (1) is needed.

The protection scope of this application is specified under claims and cannot be restricted to the descriptions given only for demonstration purposes. It is clear that any innovation to be provided by a person skilled in the art by means of change in parts in form and use of similar embodiments can be applied in other areas for similar purposes. Therefore, it is obvious that such embodiments will lack criteria of invention.

The invention claimed is:

1. A locking system comprising:

a locking bolt mounted inside a lock in order to provide a locking process in electronic gates, drawers, cabinets, safes and similar structures, the locking bolt having a locking position by entering into a lock housing structured on the lock and an unlocking position by removing from the lock housing;

a motor providing a driving force for the locking bolt to enter into the lock housing and remove from the lock housing;

a worm gear performing rotational motion around its own axis by means of the driving force from the motor and comprising a helical groove thereon; and a linear guiding member comprising teeth structured in saw tooth form;

a shaft having contact with the worm gear and moving through the helical groove of the worm gear by means of the rotational motion of the worm gear;

a first motion transmission member connected to the shaft and positioned on the linear guiding member, the first motion transmission member having a generally tapered shape with the shaft connected at a narrow end thereof and comprising teeth structured in saw tooth form at a wide end thereof, the teeth of the first motion transmission member extending through part of a segment of a circle to mesh with the guiding member teeth and to cause the first motion transmission member to rock and move on the guiding member teeth; and a second motion transmission member connected to the first motion transmission member, which enables the lock to be locked and unlocked by making the locking bolt enter into the lock housing or remove from the housing by moving with the first motion transmission member.

2. The locking system according to claim 1, comprising a compression member on the first motion transmission member, to which the second motion transmission member is connected.

3. The locking system according to claim 1, wherein the second motion transmission member is a spring.

4. The locking system according to claim 1, wherein the second motion transmission member is made of rigid plastic and plastic derivatives.

5. The locking system according to claim 1, comprising a connection member providing the connection of the shaft with the first motion transmission member.

6. The locking system according to claim 5, comprising a housing structured on the first motion transmission member and in which the connection member is mounted on the first motion transmission member.

7. The locking system according to claim 1, wherein the guiding member is a rack gear.

8. A locking method comprising:

a locking bolt mounted inside a lock in order to provide a locking process in electronic gates, drawers, cabinets, safes and similar structures, being in the locking position by entering into a lock housing structured on the lock and being in the unlocking position by removing from the lock housing;

a motor providing a driving force in order for the locking bolt to enter into the lock housing and remove from the lock housing;

a worm gear performing rotational motion around its own axis by means of the driving force from the motor and comprising a helical groove thereon;

a linear guiding member, a shaft connected to the worm gear, a first motion transmission member connected to the linear guiding member and the shaft, and a second motion transmission member connected to the first motion transmission member, the first motion transmission member having a generally tapered shape with the shaft connected at a narrow end thereof and comprising teeth structured in saw tooth form at a wide end thereof, the teeth extending through part of a segment of a circle to move on the guiding member, the method comprising the following process steps:

activating the motor to cause the worm gear to perform rotational motion around its own axis in clockwise or counter clockwise by means of the driving force from the motor;

the shaft moving based on the rotation direction of the worm gear around its own axis, the shaft moving through the helical groove of the worm gear;

the first motion transmission member moving due to movement of the shaft in a manner to rock on the linear guiding member which comprising teeth aiding the motion of the first motion transmission member and structured in such a manner to mesh with the teeth of the first motion transmission member;

a free end of said second motion transmission member is connected to the locking bolt and moves up and down in accordance with the motion direction of the first motion transmission member; and in accordance with the motion of the second motion transmission member, the locking bolt entering into the lock housing and removing from the lock housing, thus the lock is in either locked position or unlocked position.

* * * * *